US010646077B2

(12) United States Patent
Bear et al.

(10) Patent No.: US 10,646,077 B2
(45) Date of Patent: May 12, 2020

(54) COMPLETE BACK SCRUBBER

(71) Applicants: Frieda Bear, West Chester, OH (US); Mert Bal, Hamilton, OH (US)

(72) Inventors: Frieda Bear, West Chester, OH (US); Mert Bal, Hamilton, OH (US)

( * ) Notice: Subject to any disclaimer, the term of this patent is extended or adjusted under 35 U.S.C. 154(b) by 0 days.

(21) Appl. No.: 16/399,360

(22) Filed: Apr. 30, 2019

(65) Prior Publication Data

US 2019/0335959 A1 Nov. 7, 2019

Related U.S. Application Data

(60) Provisional application No. 62/665,779, filed on May 2, 2018.

(51) Int. Cl.
*A47K 7/02* (2006.01)

(52) U.S. Cl.
CPC ..... *A47K 7/024* (2013.01); *A46B 2200/1006* (2013.01)

(58) Field of Classification Search
CPC ..... A47K 7/024
USPC ..... 4/606
See application file for complete search history.

(56) References Cited

U.S. PATENT DOCUMENTS 6,370,722 B1 4/2002 Duckworth
6,647,564 B1 11/2003 Smith
6,907,624 B2 6/2005 Wang et al.
6,996,861 B1 2/2006 Clark
7,155,769 B1 1/2007 Baker
7,434,287 B1 10/2008 Borges
8,621,679 B1 1/2014 Donikian
8,631,523 B1 1/2014 Schneider
8,640,277 B1 2/2014 Alba
8,726,445 B1 5/2014 Wagner et al.
9,271,614 B2 3/2016 Rowles
2006/0107473 A1* 5/2006 Torres ..... A47K 7/024 15/21.1
2009/0113616 A1 5/2009 Daly

* cited by examiner

*Primary Examiner* — Lauren A Crane
(74) *Attorney, Agent, or Firm* — Law Office of Fran Sweeney LLC

(57) ABSTRACT

The core components of the invention are a frame, an upper carriage rail assembly, a lower carriage rail assembly, a brush, and two motor assemblies. The carriage rail assemblies are housed within a waterproof cover. The top of the cover is configured as a hood to protect the upper carriage rail assembly from water damage. The frame mounts onto the shower wall through the use of suction cups. The carriage assembly attaches to the frame through the use of screws on the frame and keyhole shaped mounting holes on the cover. The brush mounts onto an upper carriage assembly and a lower carriage assembly through the use of flanges. A stepper motor located on the upper carriage assembly drives a pulley system, allowing the brush to move horizontally from left to right and then from right to left. A panel of control buttons provide start and stop options, allowing the operator to increase or decrease the speed of the horizontal movement of the brush across the upper and lower carriage rails, and permitting the operator to start and stop the brush motion.

11 Claims, 14 Drawing Sheets

FIG. 14B
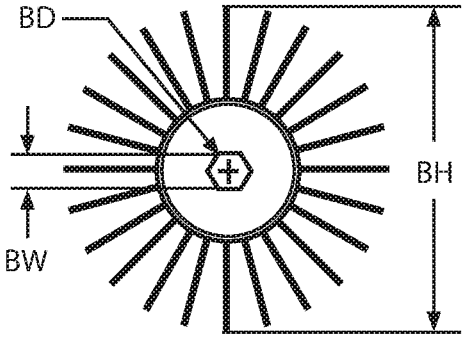
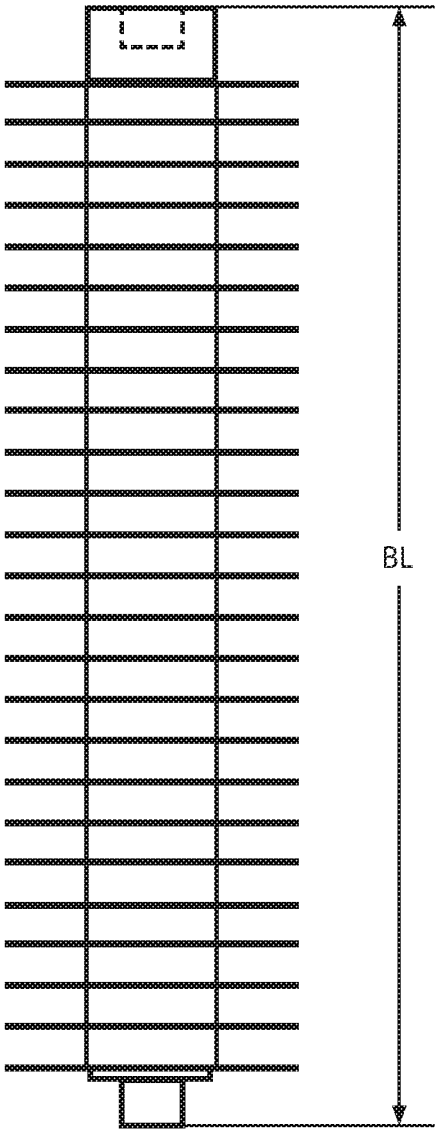
FIG. 14C
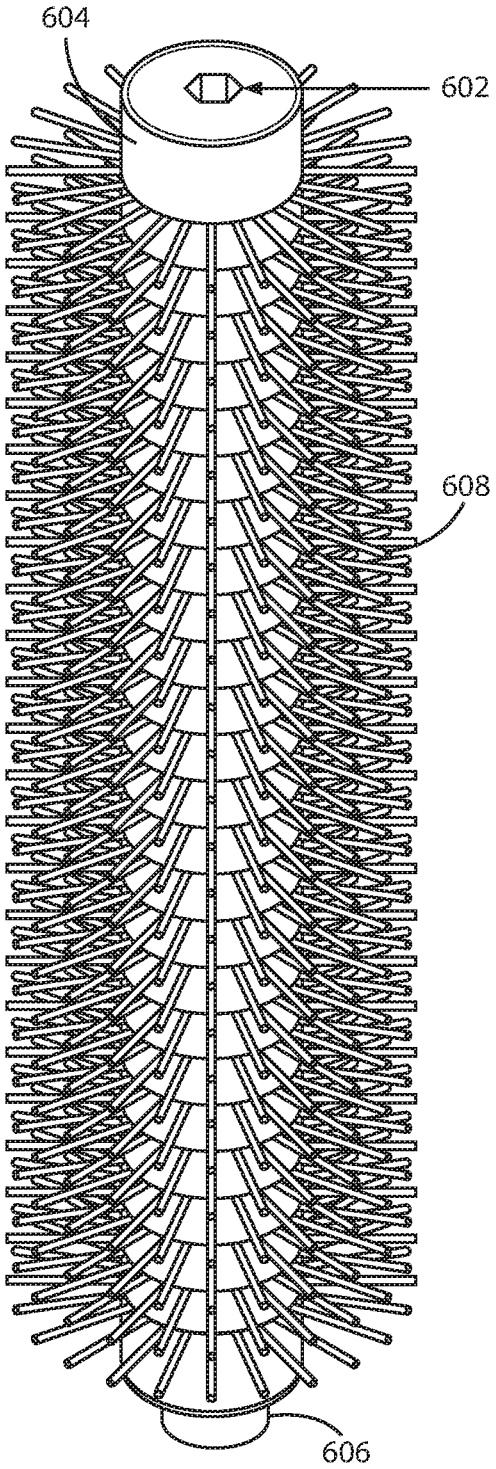
FIG. 14A

COMPLETE BACK SCRUBBER

BACKGROUND OF THE INVENTION

(1) Field of the Invention

The present disclosure is a complete back scrubber that mounts onto a shower wall.

(2) Description of the Related Art

Currently, a number of back scrubbers on the market mount on the shower wall with various configurations of brushes. However, these devices suffer from various drawbacks and challenges. There is no easily wall-mounted complete back scrubber with an adjustable speed brush that moves from right to left, then left to right, allowing the individual to remain stationery while receiving the brush over all portions of his or her back.

Thus, an unaddressed need exists in the industry for a complete back scrubber to resolve these deficiencies and inadequacies.

BRIEF SUMMARY OF THE INVENTION

According to aspects of the present invention, a brush assembly mountable on a shower wall is presented. The brush assembly moves horizontally from left to right and right to left. The core components of the invention are a cover, an upper carriage rail assembly, a lower carriage rail assembly, a brush, two motor assemblies and a frame. The upper carriage rail assembly and lower carriage rail assembly are housed within the cover. A cover top is configured as a hood to protect the upper carriage rail assembly from water damage. A lower flange-operating slot located along the bottom portion of the cover protects the lower carriage rail assembly from water damage. The core components are configured as follows: The frame mounts onto the shower wall through the use of suction cups. The upper carriage rail assembly and lower carriage rail assembly attaches to the cover and the cover attaches to the frame through the use of screws on the frame and keyhole shaped mounting holes on the cover. The upper carriage assembly and the lower carriage assembly are horizontal and parallel to each other and are in turn connected by two vertically situated support brackets and a connecting rod. A brush mounts onto the upper carriage rail assembly and lower carriage rail assembly through the use of flanges. A stepper motor located on the upper carriage assembly drives a pulley system, allowing the brush to move horizontally from left to right and then from right to left at a fixed speed. The rate at which the brush moves along the horizontal carriage assemblies is determined by a panel of control buttons located on a plate attached to a control circuit box or on a hand held remote control device. The invention can be used to scrub the backs of elderly and disabled people who have trouble reaching and bathing their backs. Furthermore, it should be noted that a rechargeable battery mounted onto a portion of the top of the cover provides the power for the motor located on the upper carriage rail assembly. An emergency button acts as a kill switch. The finished product shows a secure water tight cover applied over the various components to protect the operating parts from getting wet during use. Drainage slots located along the bottom of the cover allow any water that may enter through the lower flange operating slot to be removed upon entry.

Other systems, devices, methods, features, and advantages will be or become apparent to one with skill in the art upon examination of the following drawings and detailed description. It is intended that all such additional systems, methods, features, and advantages included within this description be within the scope of the present device, and be protected by the accompanying claims.

BRIEF DESCRIPTION OF THE SEVERAL VIEWS OF THE DRAWINGS

FIG. 14A is an isometric view of a brush.

FIG. 14B is a top view of a brush.

FIG. 14C is a sectional view of a brush.

DESCRIPTION OF THE INVENTION

Figure 1:
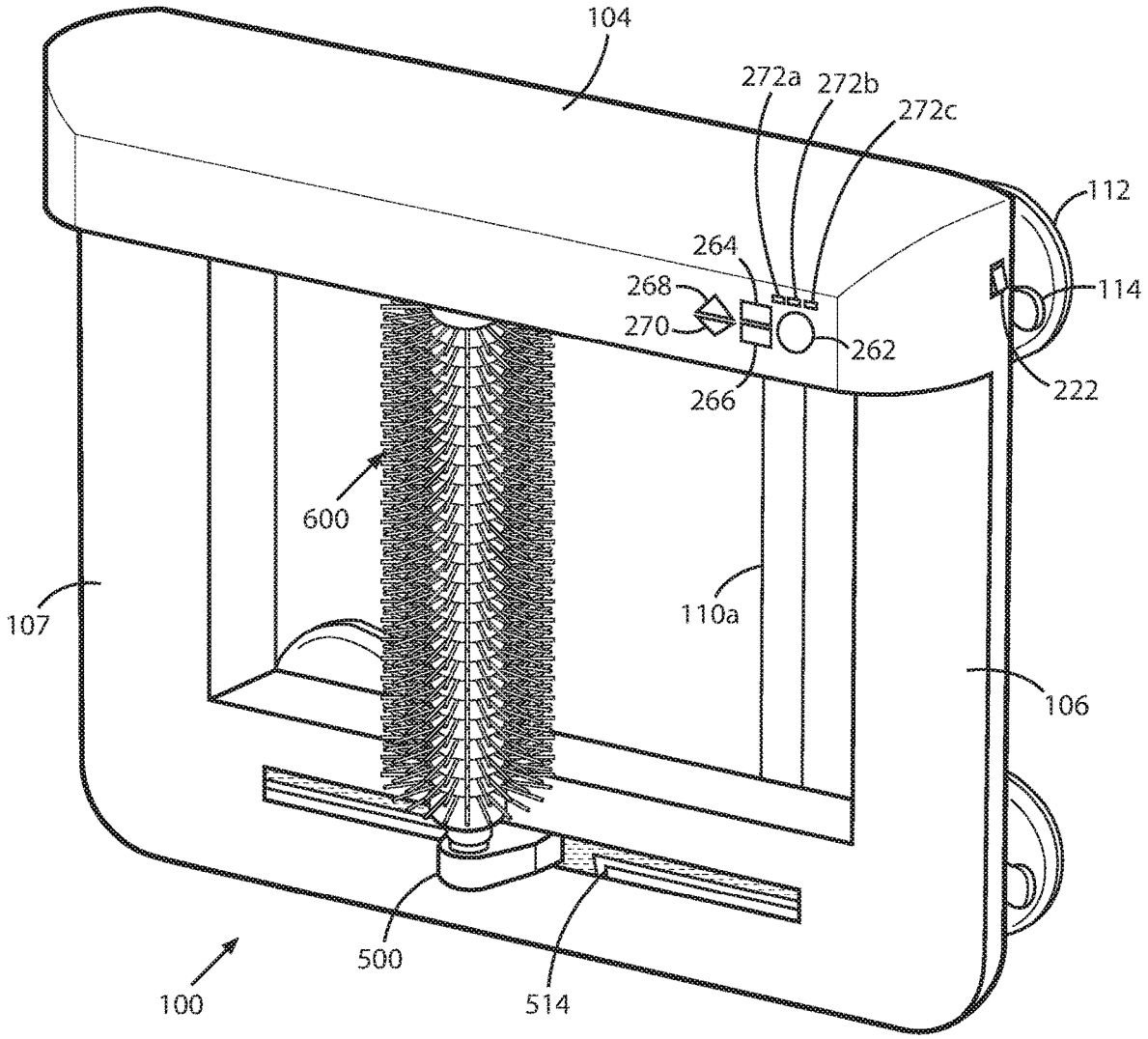
FIG. 1 is a front view of a complete back scrubber.

The following part numbers and names are identified:

100 Complete back scrubber
102 Cover
104 Cover—top
105 Cover—front
**105*a*** Cover—front, recessed portion
106 Cover—right side
107 Cover—left side
108 Cover—bottom side
**108*a*** Drainage slots
109 Cover—back
110 Frame
**110*a*** Front of frame
**110*b*** Back of frame
**110*c*** Right side of frame
**110*d*** Left side of frame
112 Suction cup
114 Suction cup lever
**114*a*** Suction cup lever position when moving towards the suction cup
**114*b*** Suction cup lever position when moving away from the suction cup
116 Suction cup connector

118 Frame mounting screw
120 Frame mounting screw knob end
122 Mounting ports
130 Connecting rod
132*a* Upper coupling
132*b* Lower coupling
134*a* Upper right idler gear
134*b* Lower right idler gear
134*c* Upper left idler gear
134*d* Lower left idler gear
136 Right connecting support rail
138 Left connecting support rail
200 Upper carriage rail assembly
202 Upper V-Slot Rail
202*a* Recessed V-slot for upper carriage wheels
202*b* Recessed V-slot for upper timing belt
202*b* Interior V-slot cavity to receive upper timing belt
202*d* Recessed V-slot for upper carriage wheels
206 Upper carriage plate
208*a* Upper top carriage wheels
208*b* Upper bottom carriage wheels
210 Upper carriage rail mounting screws
212 Upper timing belt
214 Upper right rail support bracket
216 Upper left rail support bracket
218 Battery module
220 Control circuit box
222 Power switch
240 Right limit switch
242 Left limit switch
260 Control panel
262 Emergency stop/End cycle button
264 Sweep start button
266 Sweep stop button
268 Increase brush speed
270 Decrease brush speed
272*a* Red LED indicator light
272*b* Yellow LED indicator light
272*c* Green LED indicator light
280 Stepper motor
300 Upper flange
302 DC motor and gear-box
304 DC motor mounting screws
310 Upper flange to carriage mounting screw
312 DC motor mounting plate
314 DC motor shaft
400 Lower carriage rail assembly
402 Lower V-slot rail
402*a* Recessed V-slot for lower carriage wheels
402*b* Recessed V-slot for lower timing belt
402*c* Interior V-slot cavity to receive lower timing belt
402*d* Recessed V-slot for lower carriage wheels
406 Lower carriage plate
408*a* Lower top carriage wheels
408*b* Lower bottom carriage wheels
410 Lower carriage rail wheel mounting screws
412 Lower timing belt
414 Lower right rail support bracket
416 Lower left rail support bracket
500 Lower flange
502 Brush lock release slider
504 Slider compression spring
506 Push release brush base
508 Push release brush base compression spring
510 Lower flange to carriage mounting screws
512 Brush holder slot
514 Lower flange operating slot
600 Brush
602 Hexagonal slot
604 Upper flange connecting adapter
606 Lower flange connecting adapter
608 Bristles The following terms are defined:

As used herein, the term "cover" denotes a "housing", "shell" or "container."

As used herein, the term "device" is used interchangeably with the term language "complete back scrubber."

As used herein, the term "hood" denotes an enclosure that protects something, especially from above.

(2) DETAILED DESCRIPTION

Reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

Although exemplary embodiments are shown and described, it will be clear to those of ordinary skill in the art that a number of changes, modifications, or alterations to the disclosure as described may be made. One skilled in the art of complete back scrubbers will appreciate that a number of permutations of these technologies can be added and included without altering the terms described and claimed herein.

Referring now to FIG. 1, the preferred embodiment of a complete back scrubber 100, a cover 102 may be made of a formable material such as polypropylene, nylon, glass filled polypropylene or glass filled nylon. The cover 102 is waterproof with watertight seals. The process of waterproofing and creating watertight seals protects the operating parts. The cover's 102 sides are rounded in order to prevent the user from potential injury from coming into contact with the sharp edges of other known devices. A cover top 104 of serves as a hood, protecting an upper flange 300 from exposure to water.

Figure 4:
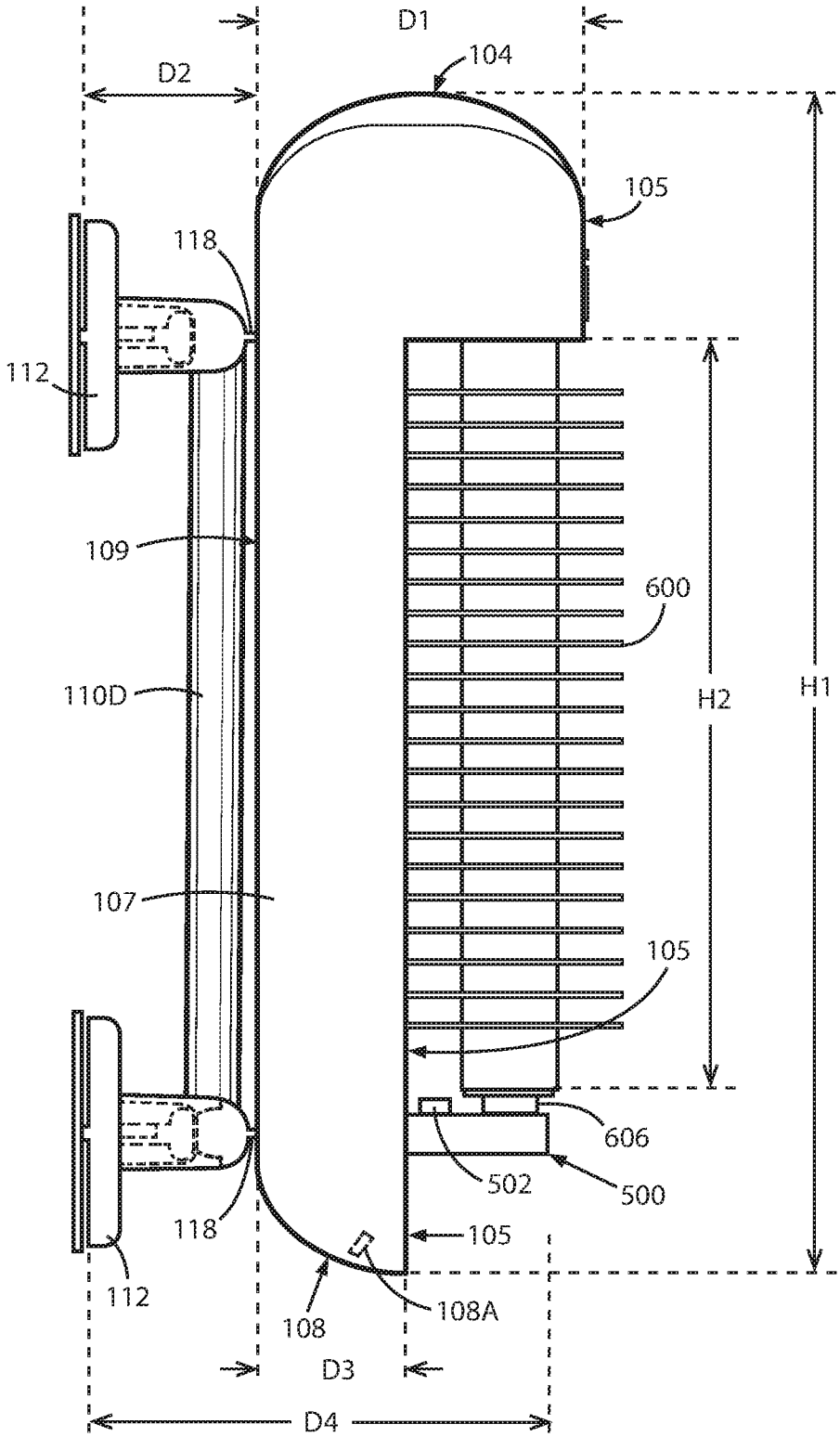
FIG. 4 is a left side view of the complete back scrubber.

Referring to FIG. 4, a left side view of the device 100 is shown. A left side of the cover 107 is attached to a left side of the frame 110*d* through the use of frame mounting screws 118 where the frame mounting screws 118 are attached directly to suction cups 112. The cover top 104 is rounded and extends from the left side 107 of the cover 100 to form a hood. In the preferred embodiment, the cover top 104 is approximately 5.2 inches deep D1 when measured from a cover back 109 to a cover front 105. The remainder of the cover 102, D3, is approximately 2.4 inches deep. The height H1 of the cover 102 in the preferred embodiment from the cover top 104 to the cover bottom 108 is approximately 19 inches. The height 112 of the brush 600 is approximately 12 inches. The depth D2, from the cover back 109 to the suction cups 112, is approximately 2.8 inches. The depth D4 of the device from a lower flange 500 to the point where the suction cups 112 attach to a shower wall is approximately 7.6 inches. The width of the complete back scrubber 100 as seen in FIG. 1 from a cover-right side 106 to the cover—left side 107 is approximately 23 inches.

Figure 6:
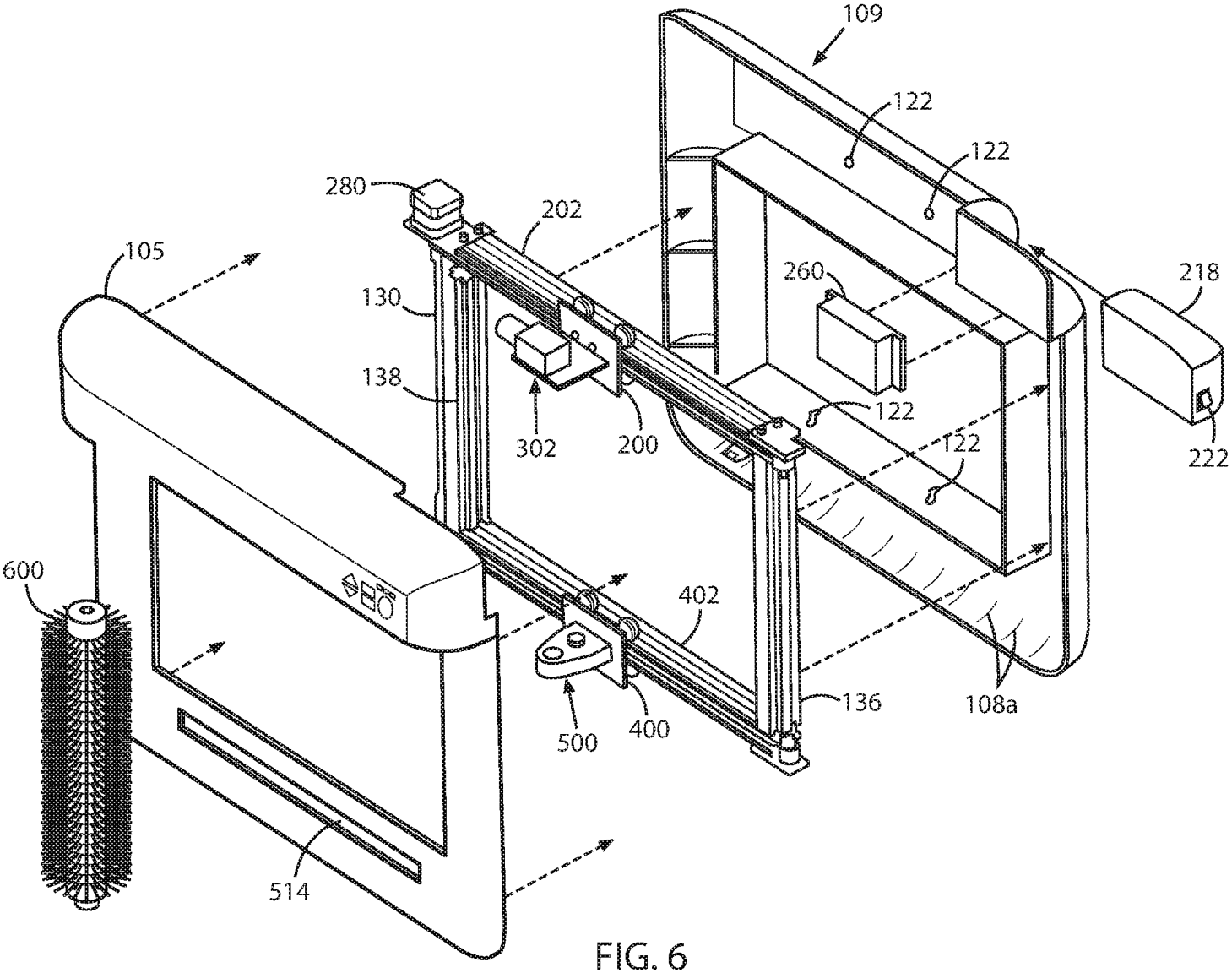
FIG. 6 is an isometric view of front and back covers, upper rail assembly, lower rail assembly, and brush.
Figure 12:
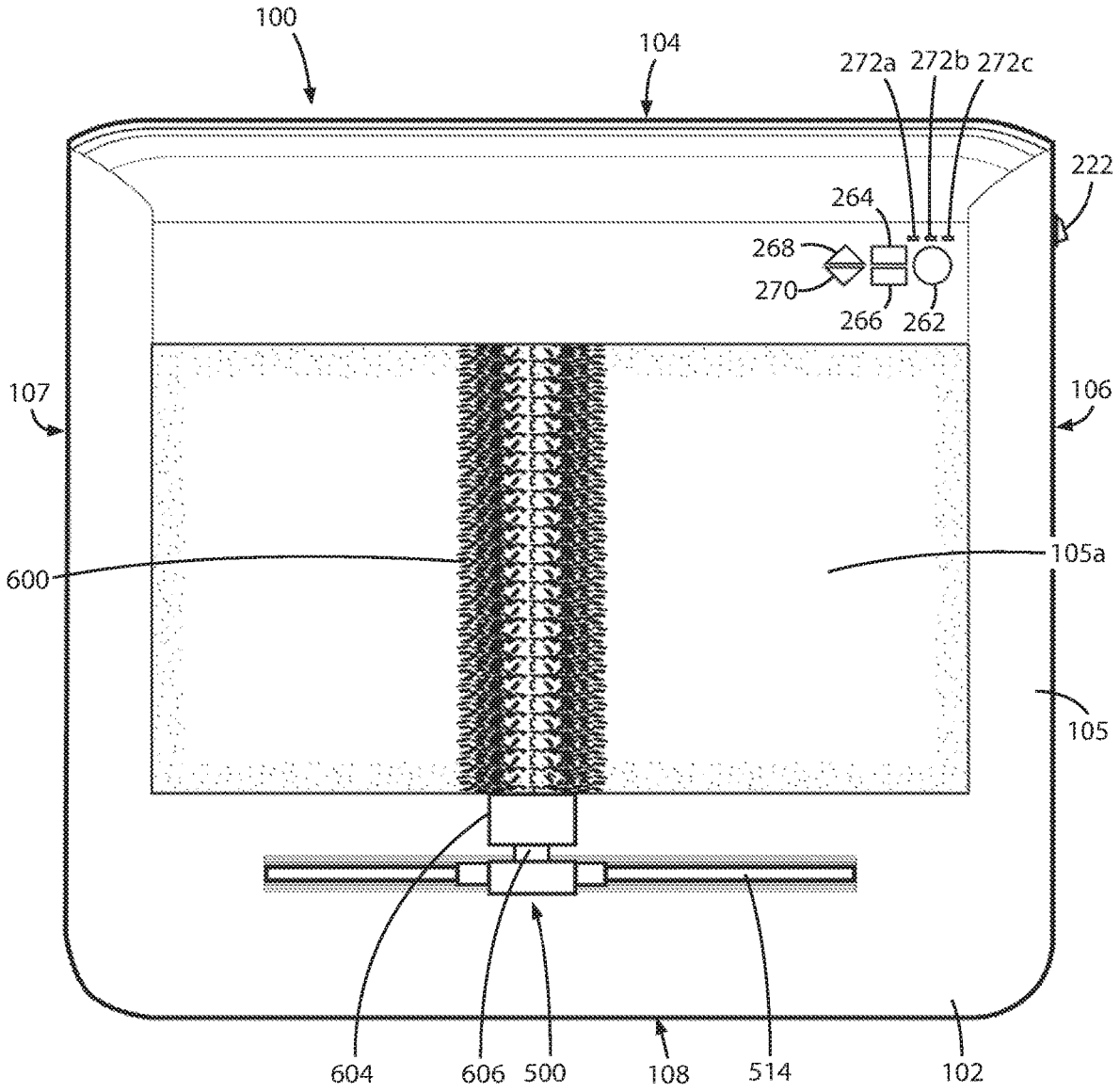
FIG. 12 is a front view a complete back scrubber.
Figures 13A, 13B:
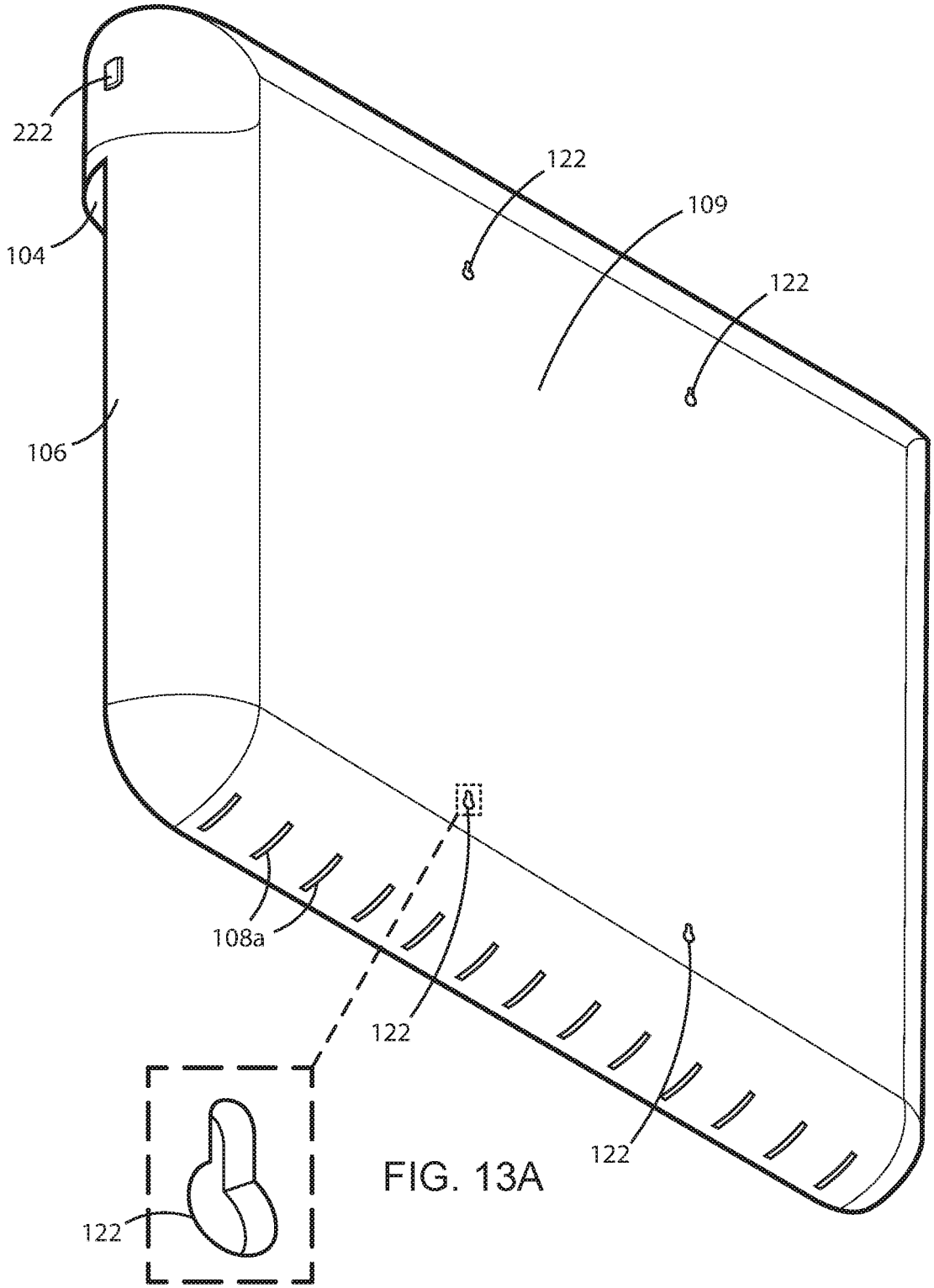
FIG. 13A is a rear isometric view of a cover.
FIG. 13B is an exploded view of a mounting hole.

In one embodiment and referring to FIG. 12, a cover front 105 is a solid piece that includes a recessed portion 105*a*. The recessed portions 105*a* shown in FIG. 12 will allow ample room for a brush 600. In the preferred embodiment and referring to FIG. 1, the cover 102 is actually a four-sided rectangle with a window-like arrangement in the center that may allow various parts of a frame 110 to be seen. As seen in FIG. 6 and in FIG. 13A, the cover bottom 108 has a series of drainage holes 108*a* in the event water enters the device through a lower flange-operating slot 514.

Figure 8:
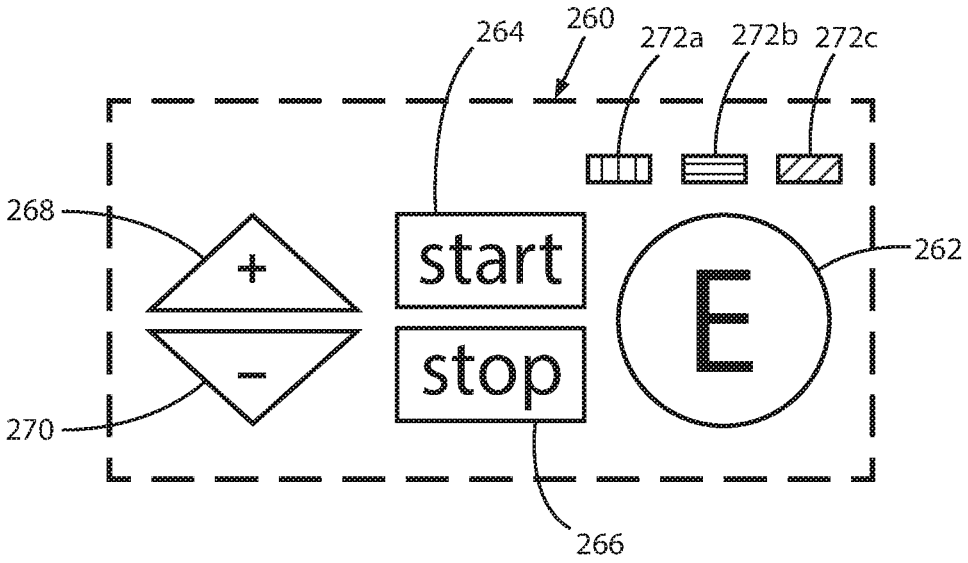
FIG. 8 is an exploded view of a control panel.

Still referring to FIG. 1, a power switch 222 located on the right side 106 of the cover 102 allows the operator to turn the device off and on. In one embodiment, a control panel 260 shown in the exploded view in FIG. 8 is located on the upper right portion of the cover front 105 as shown in FIG. 1. Referring to the exploded view of the control panel 260 in FIG. 8, a sweep start button 264 and a sweep stop button 266 start and stop the horizontal motion of the brush, allowing a user to remain stationary during the back scrubbing action. Additional control buttons allow the operator to increase 268 the horizontal speed of the brush 600 or decrease 270 the horizontal speed of the brush 600. An emergency stop/end cycle button 262 (kill switch) allows the operator to quickly stop the device. Three LED indicators 272 are shown in the upper portion of the control panel 260. A red indicator light 272*a* appears if the battery power is low and the battery needs to be removed and charged. A yellow indicator light 272*b* appears when the brush sweep action has been started or stopped. A green indicator light 272*c* tells the operator that the device is in standby but is charged and ready to use. In the preferred embodiment, the control panel buttons (262, 264, 268, and 270) do not appear on the top right portion of the hood as seen in FIG. 1. Instead, the control panel buttons (262, 264, 268, and 270) are programmed on a hand held remote control device.

Figures 5A, 5B:
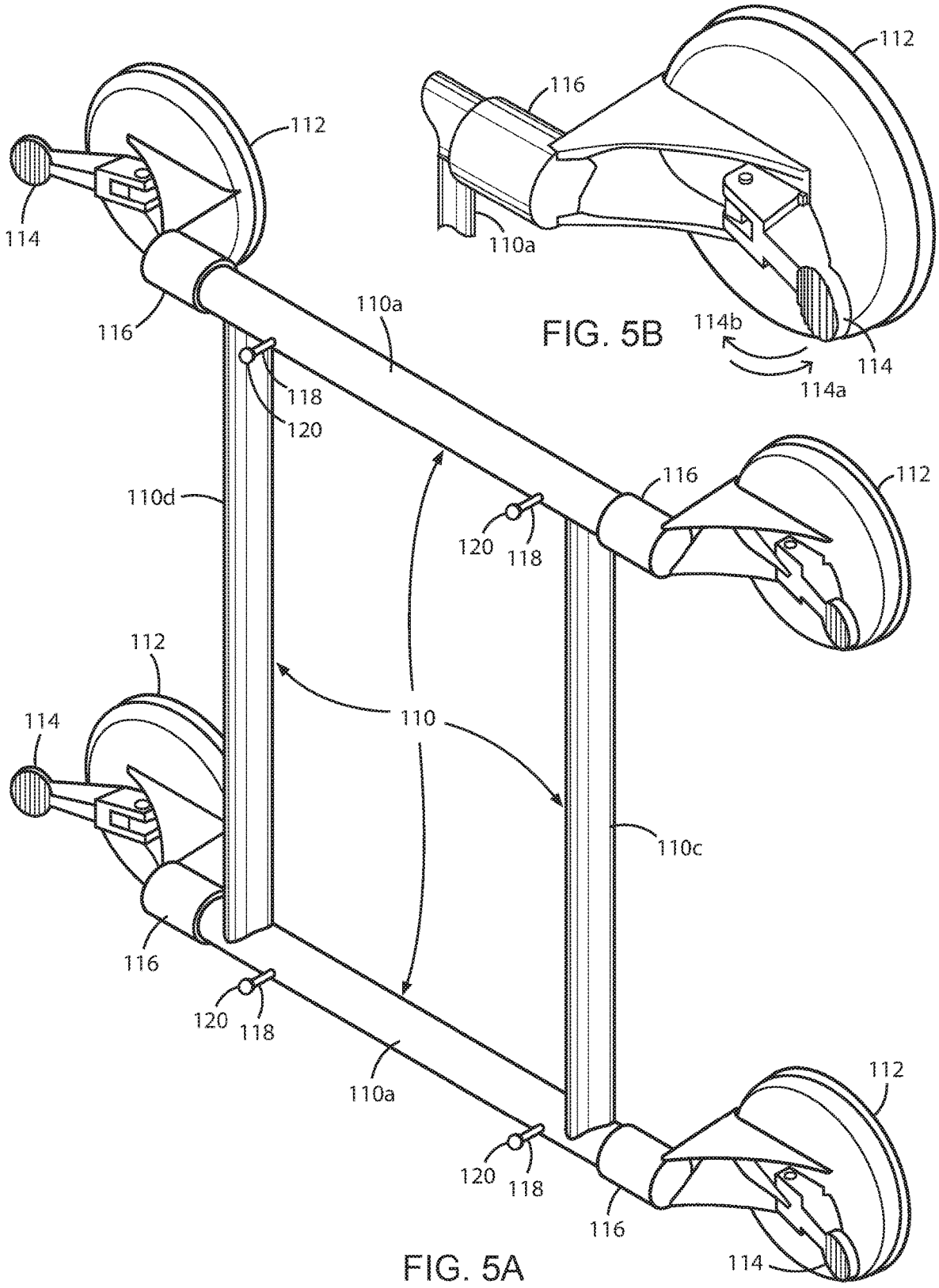
FIG. 5A is a front isometric view of a frame.
FIG. 5B is an exploded rear view of a suction cup.

Referring to FIG. 6 and FIG. 13, the cover back 109 has four holes that one in the art will recognize to be configured in the shape of standard keyholes. The standard keyholes are purposed as mounting ports 122 for the frame mounting screws 118. The mounting ports 122 shown in FIG. 6 receive frame-mounting screws 118 located on the front 110*a* of the device's frame 110 as shown in FIG. 5A. The frame mounting screws 118 originate at locations along a frame front 110*a*. Four frame mounting screws 118 terminate at locations along the top and bottom portions of a frame back 110*b*. Each frame mounting screw 118 has a frame mounting screw knob end 120 that is larger in diameter than its respective frame mounting screw 118. When the frame mounting screw knob end 120 is inserted into its corresponding mounting port 122, components of the device 100 that are operatively attached to the cover 102 rest on the frame mounting screws 118 and frame 110. Referring now to FIG. 5A, the frame 110, 110*a*, 110*c* is a rectangle. In one embodiment, the frame 110 is made from four round hollow tubes, each with an outside diameter of about one inch. In another embodiment, the frame 110 is made from a round hollow tube of about one half of one inch.

Figure 3:
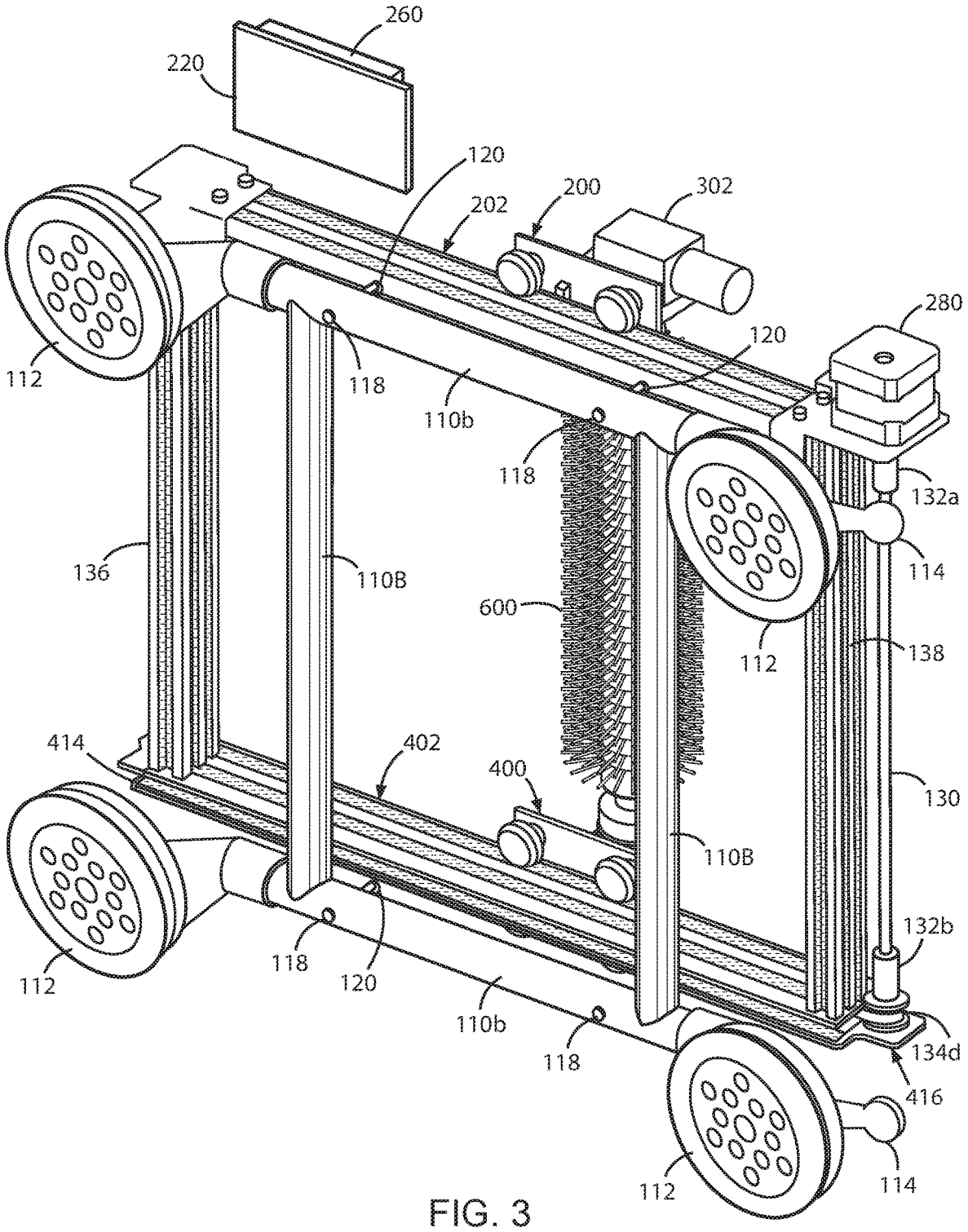
FIG. 3 is a rear perspective view of a complete back scrubber without a cover.

In the preferred embodiment of the frame FIG. 1, and referring to FIG. 3, there are four suction cups 112 situated at the four corners of the frame 110. Referring to FIG. 5A, the suction cups 112 are operatively connected to the frame 110 by suction cup connectors 116. When the suction cups 112 are placed in contact with a shower wall, and referring to FIG. 5B, the user grasps a suction cup lever 114 and pushes the suction cup lever 114 towards 114*a* a respective suction cup 112. Still referring to FIG. 5B, the device 100 may be released from a shower wall when a user pushes a suction cup lever 114 away from 114*b* a respective suction cup 112. In another embodiment, the suction cups 112 could be located on the back of the cover 102, eliminating the need for the frame 110.

Figure 2:
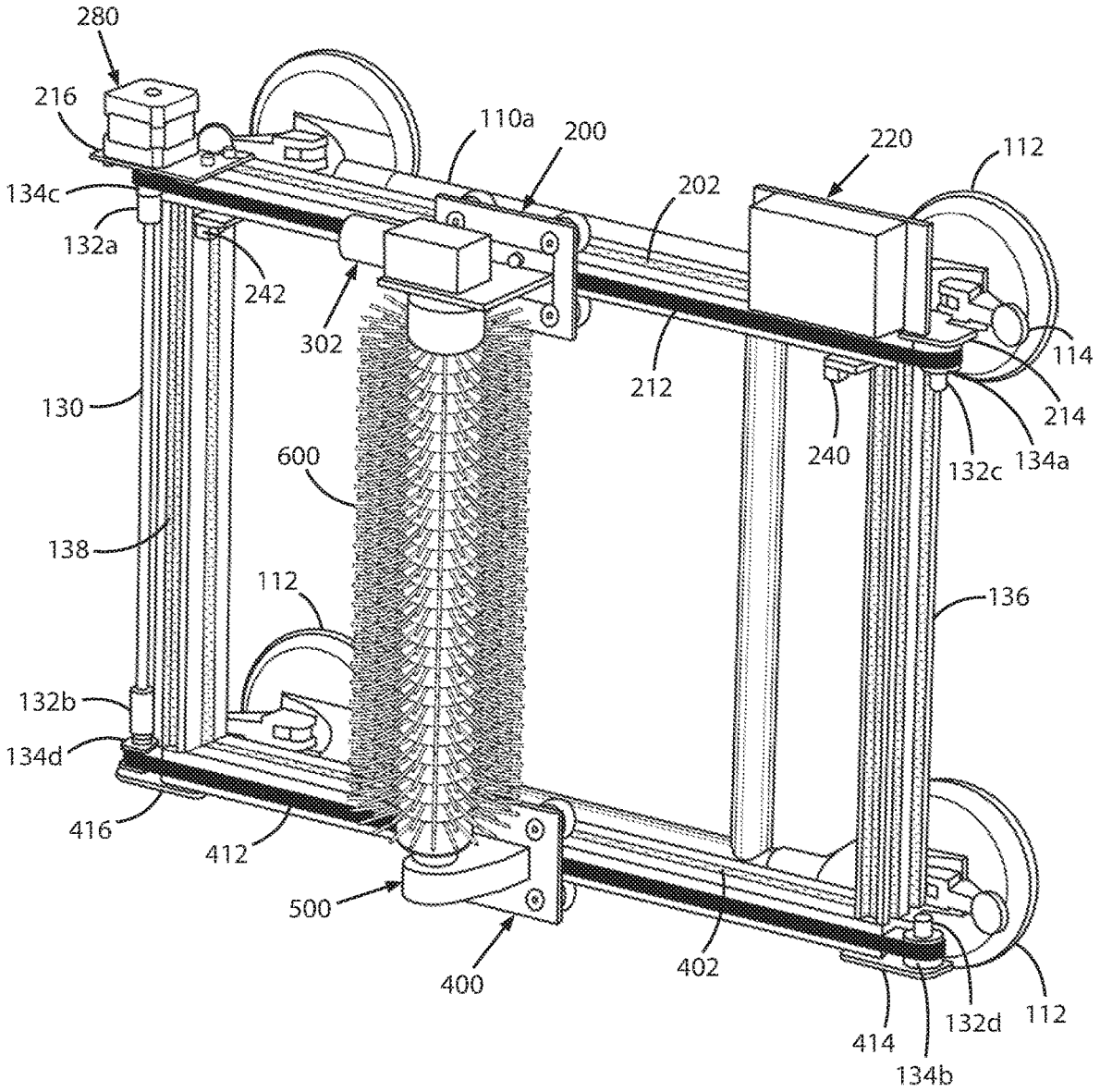
FIG. 2 is a front perspective view of a complete back scrubber without a cover.

FIG. 2 shows the device with the cover 102 removed, exposing the top of the frame 110*a*, an upper carriage rail assembly 200 and a lower carriage rail assembly 400. The upper carriage rail assembly 200 and the lower carriage rail assembly 400 are mounted onto an upper v-slot rail 202 a lower v-slot rail 402 respectively. The upper v-slot rail 202 and lower v-slot rail 402 are parallel to each other and are horizontally positioned. The upper v-slot rail 202 and lower v-slot rail 402 function as the guide rails for the horizontal linear motion of the brush 600. An right connecting support rail 136 and a left connecting support rail 138 are positioned vertically to support the upper v-slot rail 202 and lower v-slot rail 402 with added stability.

Again referring to FIG. 2, a stepper motor 280 is a brushless DC electric variable speed motor that divides a full rotation into a number of equal steps. The motor's position can then be commanded to move and hold at one of these steps without any position sensor for feedback, as long as the motor is carefully sized to the application with respect to torque and speed. The stepper motor 280 is mounted onto the top-side of an upper left support bracket 216. A connecting rod 130 originates at the stepper motor 280 and terminates at a lower left support bracket 416. The connecting rod 130 is attached at opposing ends to an upper coupling 132*a* and a lower coupling 132*b*. The upper coupling 132*a* and lower coupling 132*b* are inserted into an upper left idler gear 134*c* and a lower left idler gear 134*d* respectively. The upper left idler gear 134*c* is operatively connected to the underside of the upper left rail support bracket 216. The lower left idler gear 134*d* is operatively connected to the top surface of the lower left support bracket 416. An upper right idler gear 134*a* is mounted onto the underside of an upper right rail support bracket 214 and a lower right idler gear 134*b* is mounted onto the top surface of a lower right rail support bracket 414.

An upper timing belt 212 runs from the upper left idler gear 134*c* along the upper v-slot rail 202 and wraps around the upper right idler gear 134*a*. A lower timing belt 412 runs from the lower left idler gear 134*d* along the lower v-slot rail and wraps around the lower right idler gear 134*b*. A driver gear located within the stepper motor 280 will cause the upper left idler gear 134*c* and lower left idler gear 134*d* to move the connecting rod 130 and the upper timing belt 212 and the lower timing belt 412.

Figure 9A:
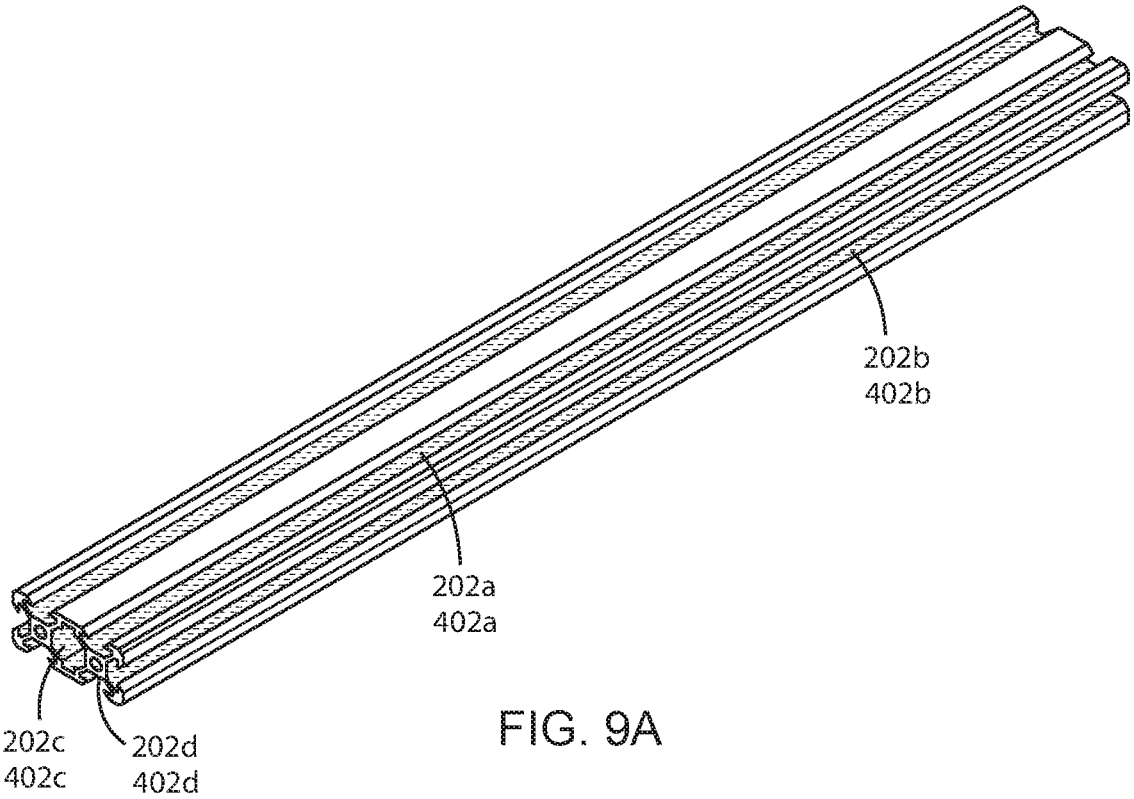
FIG. 9A is a front perspective view of a V-slot rail.
Figure 9B:
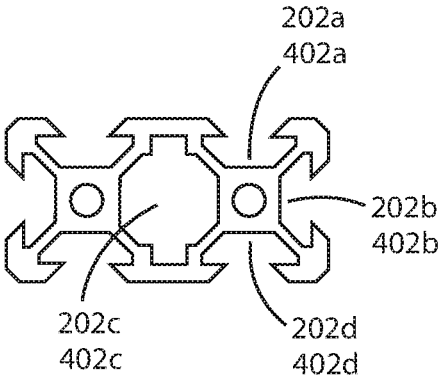
FIG. 9B is a sectional view of a V-slot rail.

Referring to FIGS. 9A and 9B the upper timing belt 212 moves along a groove 202*b* located in a side of the upper v-slot rail 202 and the lower timing belt 412 moves along a groove 402*b* located in a side of the lower v-slot rail 402. The upper timing belt 212 rotates around the upper v-slot rail 202 through the upper interior cavity 202*c* and the lower timing belt 412 rotates around lower v-slot rail 402 through the lower interior cavity 402*c*.

Figure 10A:
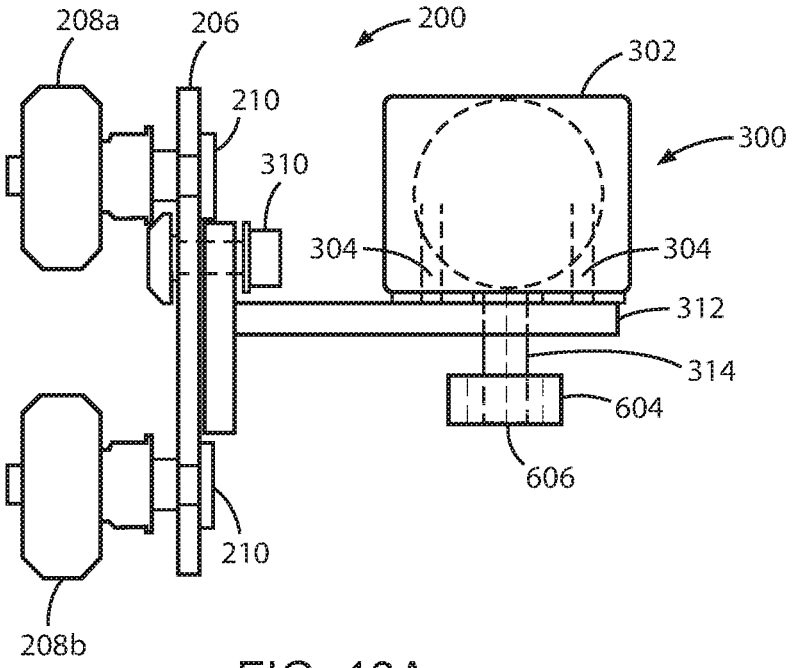
FIG. 10A is a left side view of an upper carriage rail assembly.
Figure 10B:
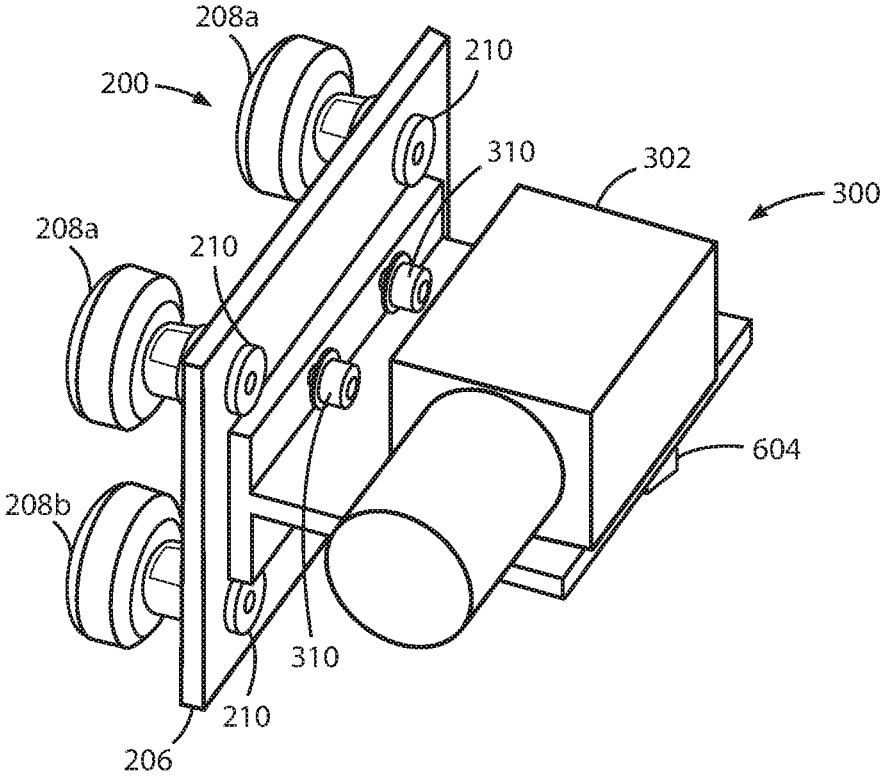
FIG. 10B is a front perspective view of an upper carriage rail assembly.
Figure 11A:
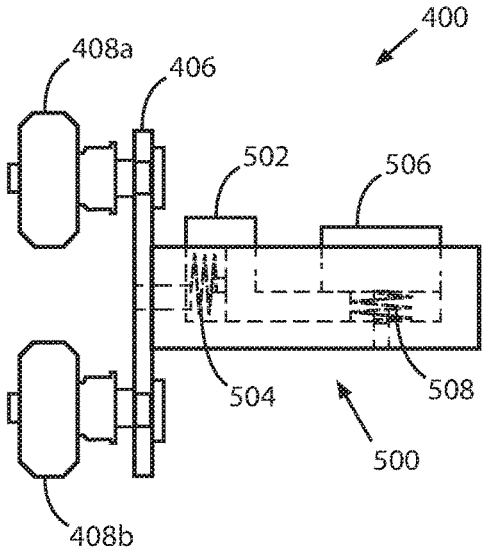
FIG. 11A is a left side view of a lower carriage rail assembly.
Figure 11B:
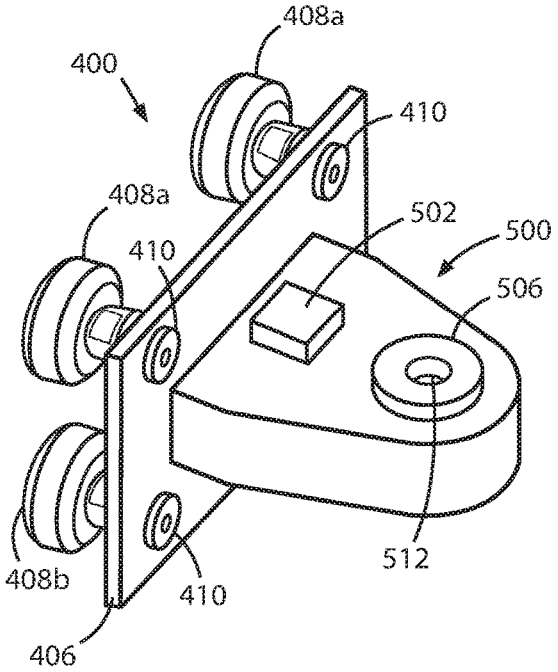
FIG. 11B is a front perspective view of a lower carriage rail assembly.

Referring now to FIGS. 10A, 10B and 11B, the upper carriage rail assembly 200 and lower rail carriage assembly 400 move horizontally across the upper and lower carriage v-slot rails 202, 402 through a system of four upper carriage wheels 208*a*, 208*b* and four lower carriage wheels 408*a* 408*b*. The upper carriage wheels 208*a*, 208*b* on the upper carriage rail assembly 200 are mounted onto an upper carriage plate 206 through the use of upper carriage rail mounting screws 210. The carriage wheels 408*a* 408*b* on the lower carriage rail assembly 400 are mounted on a lower carriage plate 406 through the use of lower carriage rail mounting screws 410. The upper flange 300 in turn mounts onto the upper carriage plate 206 through the use of upper carriage rail to flange mounting screws 310. Correspondingly, the lower flange 400 mounts onto the lower carriage plate 406 through the use of lower carriage rail to flange mounting screws 510. As seen in FIG. 2 and FIG. 9A, two top upper carriage wheels identified as 208*a* are located in recessed V-slot 202*a* and two bottom upper carriage wheels identified as 208*b* are located in recessed V-slot 202*d* on the upper carriage rail 202. Again as seen in FIG. 2 and FIG. 9A, two top lower carriage wheels identified as 408*a* are located in recessed V-slot 402*a* and two bottom lower carriage wheels identified as 408*bd* are located in recessed V-slot 402*d* on the lower carriage rail 402.

The brush 600 is made in one piece of solid plastic extrusion. Plastics extrusion is a high-volume manufacturing process in which raw plastic is melted and formed into a continuous profile. This process starts by feeding plastic material (pellets, granules, flakes or powders) from a hopper into the barrel of the extruder. The material is gradually melted by the mechanical energy generated by turning screws and by heaters arranged along the barrel. The molten polymer is then forced into a die, which shapes the polymer into a shape that hardens during cooling. There are two connecting adapters (604 and 606), one on each end of the brush 600. An upper flange-connecting adapter 604 as seen in FIG. 14A and FIG. 14B is a hexagonal shape. The upper flange-connecting adapter 604 connects to a DC motor and gearbox 302. The DC motor and gearbox 302 are located on the upper flange 300. The lower flange-connecting adapter 606 is round in all aspects and, referring to FIG. 11C is seated into the lower flange 500.

The DC motor and gearbox 302 contain a timing belt and two timing pulleys. Mounting screws 304 operatively connect the DC motor and gear box 302 to a DC mounting plate 312. The brush holder connector 606 seen in FIGS. 12A and 12B is retained within a DC motor shaft 314 as shown in FIG. 10A. Two timing pulleys operatively turn the DC motor shaft, which then allows the brush holder connector 604 to move at pre-determined rotations per minute.

Figure 11C:
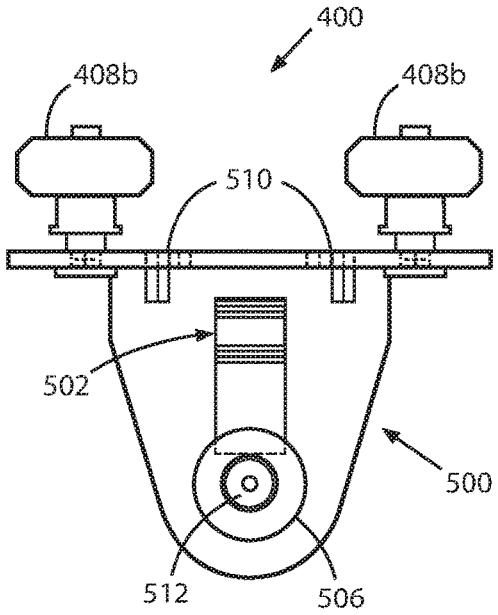
FIG. 11C is a top view of a lower carriage assembly.

The lower flange adapter 606 on the brush 600 is first inserted into a brush holder slot 512 seen in FIG. 11C. When downward pressure is applied, a push release brush base compression spring 508 seen in FIG. 11A compresses. Thereafter, the upper flange adapter 604 is inserted into the DC motor shaft 314 in the upper flange as seen in FIG. 10A. The brush 600, thus engaged, is free to rotate in a circular motion clockwise while moving linearly in a horizontal direction along the upper carriage rail assembly 200 and lower rail carriage assembly 400 to completely wash a person's back.

FIGS. 11A and 11B show the lower carriage rail assembly 400 and the lower flange 500. The lower flange 500 houses the mechanism used to mount and release the brush 600 from the upper flange 300 and lower flange 500. Referring to FIG. 11A, to remove the brush 600 from the upper flange 300 and the lower flange 500, a user must move a brush lock release slider 502 towards the brush 600. A brush lock release compression spring 504 is compressed at this point allowing the brush 600 to be released. Pushing the brush 600 downward compresses the push release brush base compression spring 508. This will release the top end of the brush 600 from the upper flange 300. Thereafter the top end of the brush 600 may be gently pulled down and away from the upper flange 300 by pushing the brush 600 downward. The brush 600 may then be removed from a push release brush base 506 by lifting the brush 600 out of the brush holder slot 512. The brush lock release slider 502 may then be returned to its original position.

Referring to FIG. 2, as the brush 600 moves horizontally along the upper carriage rail assembly 200 and the lower carriage rail assembly 400, the DC motor 302 runs at one speed. A control circuit box 220 seen in FIG. 3 is located just behind the control panel 260. The control circuit box 220 is operatively connected to the control panel 260 and is programmed to respond to the control buttons 262, 264, 266, and 268 as seen in FIG. 8. The upper and lower carriage rail assemblies 200, 400 move the brush 600 horizontally from left to right and then from right to left along the upper and lower v-slot rails 202, 402. The brush 600 generates its horizontal left to right motion through a timer located in the stepper motor 280. As seen in FIG. 2, there is a right limit switch 240 and a left limit switch 242. The right limit switch 240 is located on the upper right support bracket 214. The left limit switch 242 is located adjacent to the stepper motor 280 on the upper left rail support bracket 216. When the brush 600 reaches either of the two ends of the upper v-slot rail 202 and lower v-slot rail 402 the respective limit switch signals the stepper motor 280 to reverse the direction of the upper timing belt 212 and lower timing belt 412, sending the brush 600 across the upper v-slot rail 202 and lower v-slot rail 402 in the opposite direction.

Figure 7:
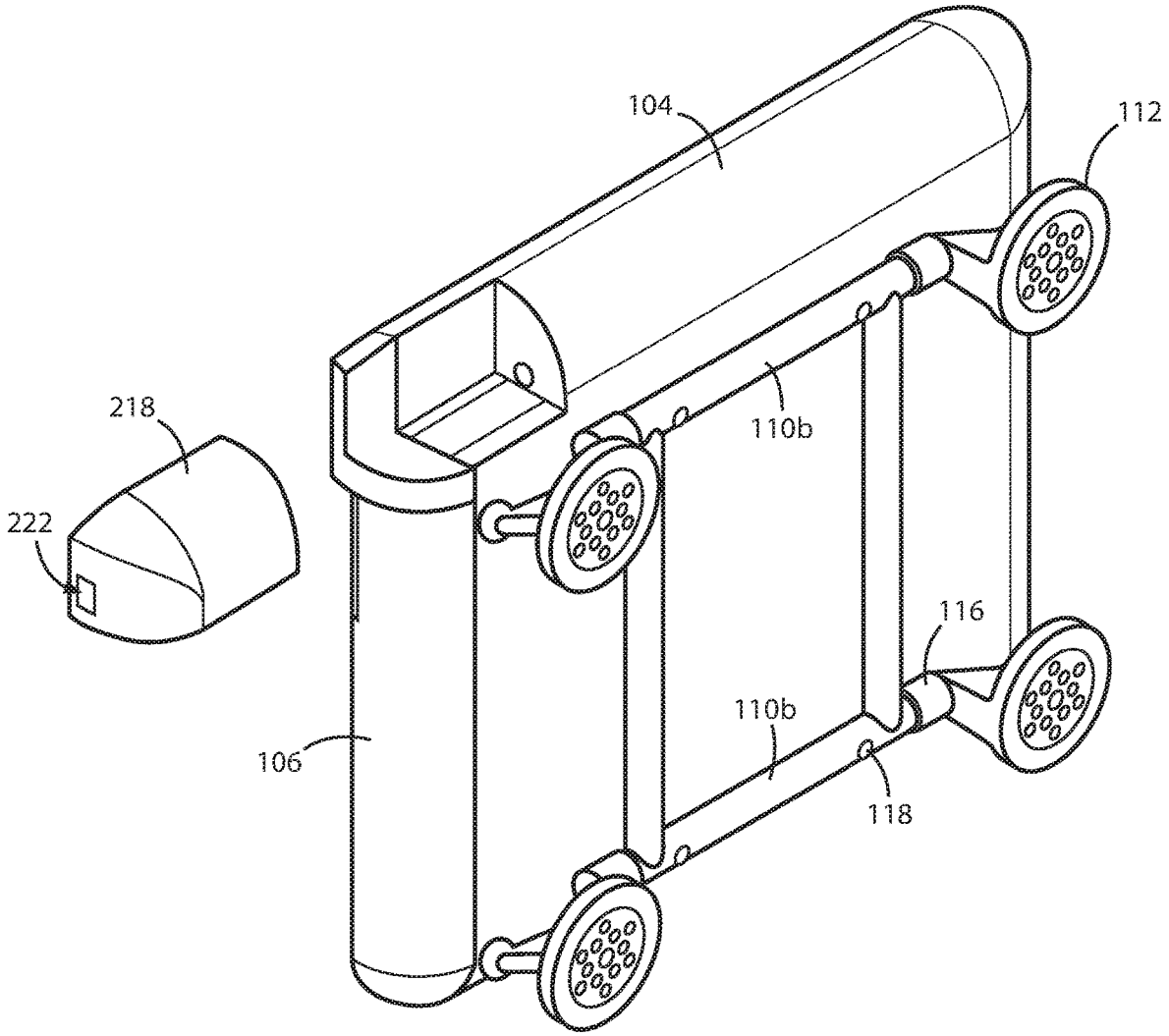
FIG. 7 is a rear perspective view of the complete back scrubber.

The device 100 is battery operated. The battery module 218 as seen in FIG. 7 is rechargeable through easy removal from the top 104 and back 109 of the cover 102. A six-volt battery that will typically last for about 2-3 hours before needing to be re-charged is used in one embodiment. The battery in the preferred embodiment is mounted through a standard v-slot located on the top cover 104 of the device 100.

The brush 600 may be produced with soft or firm twelve-inch bristles. A portion of the brush may be color coded so that individuals may install and remove his or her personal brush from the device 100. Soap is applied to bristles 608 on the brush 600. Typically the soap is removed from the brush by the end of a shower through the force of the water delivered from any standard showerhead. The brush 600 may also be made from fabrics or circular tubes for use in dry massage when the device 100 is removed from the frame 110.

For purposes of assembling the preferred embodiment of the complete back scrubber, FIG. 6 shows five individual components: (1) the front cover 105 and back cover 109, (2) the control circuit box 220, (3) the guide rails 202 and 402 and support rail systems 136 and 138, (4) the brush 600, and (5) the battery module 218.

The front cover 105 and back cover 109 are each made as a single piece, injection-molded or through a hot thermoforming-molded form. Of these two methods, the preferred method is thermoforming. Two of the suggested raw materials are acrylonitrile butadiene styrene or polyvinyl chloride.

The control circuit box 220 is also made with a plastic forming process, either injection molding or thermoforming, preferably from the acrylonitrile butadiene styrene material.

In the preferred embodiment, the upper v-slot rail 202 and lower v-slot rail 402 and the right connecting support rail 136 and the left connecting support rail 138 are made from 20×40 mm V-slot aluminum extrusion rails assembled together with mechanical fasteners to form a rectangle. The upper v-slot rail 202 and lower v-slot rail 402 function as the guide rails for the horizontal linear motion of a brush 600. The right connecting support rail 136 and the left connecting support rail 138 are positioned vertically to support the upper v-slot rail 202 and lower v-slot rail 402 with added stability.

On the upper left rail support bracket 216 located on the upper v-slot rail 202, a stepper motor 280 is installed to drive the horizontal linear motion of the brush 600. The upper flange 300 is mounted onto the upper v-slot rail 202 and the lower flange 500 is mounted onto the lower v-slot rail 402 using mechanical fasteners known to those in the art. The upper flange 300 and the lower flange 500 function as supports for the brush 600. The brush 600 is mounted on the space located between the upper flange 300 and the lower flange 500. The upper flange 300 also carries a DC motor 302 that rotates the brush 600.

The brush 600 unit is made of two components that are permanently joined together: a 1.5 inch diameter hollow plastic cylindrical core that is approximately twelve inches in length and nylon bristles 608 around the core, each approximately one inch long together with an upper flange connecting adapter 604 at the top of the brush 600 and a lower flange connecting adapter 606 at the bottom of the brush 600. The brush 600 is manufactured using a plastic extrusion process with a polyvinyl chloride thermoplastic material. A hollow cylindrical form is first extruded and the extrusion is then cut into segments of approximately twelve inches in length. The finished core is then connected to a special stitching fixture in order to add the one-inch long nylon bristles on it throughout the entire diameter and length of it. At that point, the upper flange-connecting adapter 604 and the lower flange-connecting adapter 606 are produced through an injection molding process and are joined at opposing ends of the brush 600.

To join the five components (1) the front cover 105 and back cover 109, (2) the control circuit box 220, (3) the guide rails 202 and 402 and support rail systems 136 and 138, (4) the brush 600, and (5) the battery module 218, the back cover 109 is first positioned on a horizontal surface. As seen in FIG. 6, the control circuit box 220 can be operatively connected to the back cover 109 using a system of screws and plastic pilot holes known in the art.

The guide rails 202 and 402 and support rails 136 and 138 are assembled onto the back cover 109. Those in the art will recognize that four hex-head screws inserted from behind the back cover 109 may be connected to the back face of the support rails 136 and 138. To join the screws to the support rails 136 and 138, drop forged nuts designed for standard 20×40 v-slot screws are used. It is also recommended to use rubber washers between the hex screw heads and the back cover 109 in order to seal the screw holes on the back cover 109.

The front cover 105 is now ready to be attached to the guide rails 202 and 402 and support rails 136 and 138. The front cover 105 is placed on top of the guide rails 202 and 402 and support rails 136 and 138. Those in the art will recognize that the front cover 109 may then be operatively connected directly to the back cover 109. For example, up to six screws at the top and bottom of both the back and front covers may be inserted from the back cover through holes that can be molded as part of the back cover and front cover design.

To insert the brush, and referring to FIG. 14 one first gently pulls the brush lock release slider 502 towards the complete back scrubber and inserts the lower flange-connecting adapter 606 into the brush holder slot 512 of the lower flange 500. The upper flange-connecting adapter 604 is then inserted into a hexagonal slot 602 located on the upper flange 300. Once the brush 600 is inserted into the hexagonal slot 602 the brush lock release slider 502 is released to lock the brush into place.

The battery module 218 is also designed for easy insertion and removal for maintenance and recharging purposes. It can be inserted into the battery slot at the upper corner of the back cover 109 through, for example, sliding it onto a v-shaped guidance groove. It can be removed the same way. Before inserting the battery module 218 into the complete back scrubber 100, it must be fully assembled and sealed. To assemble the battery module 218, one inserts a standard 12-volt lithium ion battery pack into the interior portion of the battery module 218, thereafter connecting the battery terminals to the emergency stop/end cycle button 262 mounted onto a male battery charging connector. After the electrical connections of the battery are completed, a cover is secured onto the battery module 218 with four screws. A sealant is then applied between the battery unit's cover and body to ensure the water tightness of the battery module. Once the battery module subassembly is completed it can be inserted into the scrubber by sliding it through the guidance groove.

USES AND BENEFITS OF THE INVENTION

It is desirable to have a motorized complete back scrubber performing a horizontal scrubbing of a person's back. The brush unit travels horizontally along an approximately eighteen-inch path. The unit allows a push button operation or remote control operation without requiring a user to bend arms upward and/or backward. Nor does the unit require assistance from a second individual. Furthermore the complete back scrubber can be positioned to use while sitting in a chair in a shower area, or mounting it at a standing height, secured on the wall in a shower for the user's ideal height. The unit provides a genuine scrubbing brush action to scrub and exfoliate and massage one's back. This is the utmost therapeutic device for the aged, disabled or handicapped persons and anyone who wishes for a thorough back scrubbing without assistance from others.

The lever system on the suction cups on the current device allows the device to be moved at any given time to another location on the same shower wall or onto another shower at another location. The portability feature allows for multiple users to access the device in homes, therapy centers and health care facilities.

The disclosed device is aesthetically pleasing and easy to assemble and operate. The cover is easily cleaned for use when sterile conditions are necessary in hospitals.

The invention claimed is:

1. A complete back scrubber comprising:

a cover, the cover having a top side, a front side, a back side, and a bottom side, the cover configured as a rectangle wherein the rectangle encloses a central transparent portion;

a first flange and a second flange;

a first set of four wheels and a second set of four wheels, wherein the first set of four wheels is operatively connected to the first flange and the second set of four wheels is operatively connected to the second flange;

a first rail and a second rail, wherein the first rail and the second rail are parallel to each other, arranged horizontally, the first rail configured to receive the first set of four wheels and the second rail configured to receive the second set of four wheels;

a first support bracket and a second support bracket, wherein the first support bracket and the second support bracket are parallel to each other and are arranged vertically;

a frame, wherein the frame comprises a front and a back, and at least one mounting screw, wherein the at least one mounting screw has a knob end to operatively engage within a corresponding opening located on the back side of the cover;

a plurality of suction cups located on the back of the frame and releaseably holding the frame on a shower wall;

a battery, wherein the battery is positioned at a location on the top side of the cover, the battery configured to be removed from the top side of the cover;

a brush, wherein the brush is operatively connected to the first flange and the second flange, the brush configured to move linearly and in a horizontal direction along the first rail and the second rail;

a first motor and a second motor, the first motor located on a section of the first rail and operatively connected to a first belt system, wherein the first belt system moves the brush along the first rail and the second rail, and the second motor located on the first flange and operatively connected to the second belt system wherein the second belt system rotates the brush;

a first detector and a second detector, the first detector and the second detector positioned at locations on the first rail, the first detector and the second detector configured to stop the movement of the brush and reverse the direction in which the brush moves along the first rail and the second rail; and a remote control device, the remote control device configured to communicate with and operate the first motor and second motor.

2. The complete back scrubber in claim 1, wherein the top side of the cover is configured as a hood.

3. The first rail in claim 1, wherein the first rail further comprises a first set of four equal sides and a first center portion, the first center portion configured to be hollow.

4. The second rail in claim 1, wherein the second rail further comprises a second set of four equal sides and a second center portion, the second center portion configured to be hollow.

5. The complete back scrubber in claim 1, wherein the first rail is located in a position higher with respect to the second rail when the complete back scrubbed is mounted vertically on a shower wall.

6. The plurality of suction cups in claim 1, wherein each suction cup in the plurality of suction cups further comprises a pressure lever and a frame connector, the frame connector configured to attach each suction cup to the back of the frame.

7. The first motor in claim 1 wherein the first motor is a variable speed motor.

8. The first flange in claim 1, further comprising a hexagonal receiving portal.

9. The second flange in claim 1 further comprising a brush lock release system.

10. The brush in claim 1, wherein the brush is comprised of bristles, a first flange connecting adapter and a second flange connecting adapter, wherein the bristles, the first flange connecting adapter and the second flange connecting adapter are configured as one piece.

11. The brush in claim 1 further comprising a band of color, wherein the band of color contrasts with a brush color.

* * * * *